US007080834B2

(12) United States Patent
Asari

(10) Patent No.: US 7,080,834 B2
(45) Date of Patent: Jul. 25, 2006

(54) SHEETS REVERSING CONTROLLER AND CONTROL METHOD

(75) Inventor: Yukio Asari, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 154 days.

(21) Appl. No.: 10/647,467

(22) Filed: Aug. 26, 2003

(65) Prior Publication Data

US 2004/0100017 A1 May 27, 2004

(30) Foreign Application Priority Data

Nov. 27, 2002 (JP) ..... 2002-343248

(51) Int. Cl.
*B65H 43/00* (2006.01)

(52) U.S. Cl. ..... 271/176; 271/186; 271/902

(58) Field of Classification Search ..... 271/185, 271/186, 176, 902, 255, 270, 303
See application file for complete search history.

(56) References Cited

U.S. PATENT DOCUMENTS

| | | | | |
|---|---|---|---|---|
| 4,331,328 | A * | 5/1982 | Fasig | 271/270 |
| 4,487,506 | A * | 12/1984 | Repp et al. | 399/401 |
| 5,449,164 | A * | 9/1995 | Quesnel et al. | 271/186 |
| 5,449,166 | A * | 9/1995 | Lohmann et al. | 271/225 |
| 5,461,468 | A * | 10/1995 | Dempsey et al. | 399/396 |
| 5,689,795 | A * | 11/1997 | Mastrandrea | 399/407 |
| 5,887,868 | A * | 3/1999 | Lambert et al. | 271/186 |
| 6,132,352 | A * | 10/2000 | Rider | 493/419 |
| 6,322,069 | B1 * | 11/2001 | Krucinski et al. | 271/265.02 |
| 6,550,762 | B1 * | 4/2003 | Stoll | 271/186 |
| 6,612,572 | B1 * | 9/2003 | Mohr et al. | 271/280 |
| 6,751,524 | B1 * | 6/2004 | Neary et al. | 700/230 |

FOREIGN PATENT DOCUMENTS

| | | |
|---|---|---|
| BE | 1 010 140 A3 | 1/1998 |
| DE | 43 15 053 A1 | 11/1994 |
| DE | 195 22 131 A1 | 1/1997 |
| EP | 0 536 778 A1 | 4/1993 |
| EP | 0 704 255 A2 | 9/1995 |
| EP | 1 295 826 A2 | 3/2003 |

OTHER PUBLICATIONS

Carlo Cloet et al., Intersheet Spacing Control and Controllability of a Copier Paperpath, Proceedings of the 1998 IEEE International Conference on Conrol Applications, Sep. 1998, IEEE, New York, NY, USA, vol. 2, p. 726-30.*

OTHER PUBLICATIONS

U.S. Appl. No. 10/233,111, filed Sep. 3, 2002, Atsushi Ina et al.

* cited by examiner

*Primary Examiner*—Kathy Matecki
*Assistant Examiner*—Thomas Morrison
(74) *Attorney, Agent, or Firm*—Pillsbury Winthrop Shaw Pittman LLP

(57) ABSTRACT

A sheet reversing controller has a first conveying path for conveying sheets in the first direction, sensors to detect lengths of sheets in the conveying direction; a reversing portion comprising a reversing roller that is capable of normal/reverse rotations for taking and reversing sheets supplied from the first conveying path and a pinch roller, and a second conveying path for taking and conveying sheets supplied in the second direction that is the reverse direction to the conveying direction of the first conveying path from the reversing portion, and a controller to control the conveyance of sheets. The controller controls a conveying gap between a sheet and a succeeding sheet on the second conveying path regardless of the length of the sheets in the conveying direction.

10 Claims, 8 Drawing Sheets

$$L1 + g1 = L2 + g2$$

SHEETS REVERSING CONTROLLER AND CONTROL METHOD

CROSS-REFERENCE TO RELATED APPLICATION

This application is based upon and claims the benefit of priority from the prior Japanese Application No. 2002-343248, filed on Nov. 27, 2002; the entire contents of which are incorporated herein by reference.

BACKGROUND OF THE INVENTION

1. Field of the Invention

This invention relates to a sheet reversing controller and a reversing control method for reversing (the switchback reversing) the conveying direction of sheets, for example, postal matters that are conveyed.

2. Description of Related Art

There is a reversing (switchback reversing) gear incorporated in a sheet processor for conveying and processing postal matters, etc. and for reversing the conveying direction of sheets conveyed.

For example, in the reversing gear disclosed in the Japanese Patent Application No. 1005-23284, there were such problems as described below. It is desirable to increase the conveying density of sheets and convey sheets without changing a conveying gap between sheets before and after the switchback reversing. However, the protruding amount of sheets from the entrance of the reversing portion when the conveyance of sheets is stopped varies depending on lengths of sheets. Therefore, it was so far difficult to design an installing position of a switching gate to a reversing path and a flap shape composing the switching gate.

The sheet length referred to here is the length of sheets in the conveying direction. Further, the conveying gap between sheets is a distance from the rear end of a sheet to the front end of a sheet that is next conveyed, and is also applicable in the following explanation.

Next, a conventional conveying control will be explained using FIG. 1.

FIG. 1A to FIG. 1D are diagrams showing a length L of a sheet protruding from a reversing roller 11 and a pinch roller 12 when the sheet 1 is conveyed in the arrow direction A and stopped in order for reversing its conveying direction (in the arrow direction B). Here, the length of the sheet 1 protruding from the reversing roller 11 and the pinch roller 12 is shown when a conveying control parameter that is constant regardless of the length of the sheet 1 was used for the sheet in an optional length.

FIG. 1A shows that a protruding length of a sheet 1 that is suited to a detecting is L when the length of the sheet 1 is most short.

In FIG. 1B, a protruding length L1 becomes longer than L because the length of the sheet 1 is longer than the length of a sheet 1 shown in FIG. 1A.

In FIG. 1C, the protruding length L2 becomes longer than L1 because the length of the sheet 1 is longer than the length of the sheet 1 in FIG. 1B.

In FIG. 1D, the protruding length L3 becomes longer than L2 because the length of the sheet 1 is longer than the length of sheet 1 n FIG. 1C.

Thus, the longer the length of a sheet 1 becomes, the longer the protruding length becomes and comes close to the switching gate provided adjacent to the upper stream side in the conveying direction. Further, the sheet 1 also becomes close to the conveying path in the reversing direction and it becomes difficult to control the turning of the switching gate.

Therefore, the tolerance of variance in protruding amount of a sheet from the entrance of the reversing portion is subject to the installed position or the swing shape of the switching gate and becomes a narrow range. In order to restrict the variance of protruding amount of a sheet in a narrow range, it was necessary to make a conveying gap between sheets wide and afford a sufficient time to the switchback reversing. Because of this, there was such a problem that the conveying density of sheets could not be increased.

Further, when a protruding amount of sheet is made constant, the conveying gap between sheets changes before and after the switchback reversing and therefore, in order to avoid its effect, it becomes also necessary to make the conveying gap wide between sheets. Accordingly, there was such a problem that the conveying density could not be increased (the high density conveying) could not be made.

SUMMARY OF THE INVENTION

It is an object of this invention to provide a sheet reversing controller and a control method for controlling a conveying gap between sheets in the high density conveyance so that it remains unchanged before and after the switchback reversing of sheets by optionally setting a protruding amount of sheets from the entrance of the reversing portion when sheets are stopped within a certain range according to the installing position and the shape of a switching gate regardless of the length of sheets.

According to this invention, a sheet reversing controller is provided. This sheet reversing controller comprises a first conveying path to convey plural sheets in a first direction with a specified gap; a reversing portion arranged at the downstream in the conveying direction of the first conveying path, comprising a reversing roller capable of normal and reverse rotations to take and reverse the sheets fed from the first conveying path and a pinch roller arranged opposing to the reversing roller; a second conveying path to take and convey the sheets fed in a second direction differing from the first direction of the first conveying path by the reversing portion; and a controller to control the conveyance of the sheets so that the conveying gap between the sheets conveyed on the second conveying path becomes equal to the specified conveying gap when conveyed on the first conveying path regardless of lengths of plural sheets.

Further, according to this invention, a sheet reversing control method is provided. This sheet reversing control method comprises conveying plural sheets on a first conveying path in a first direction with a specified gap; taking and reversing the sheets fed from the first conveying path in a reversing portion arranged at the downstream in a conveying direction of the first conveying path comprising a reversing roller that is capable of normal/reverse rotation and a pinch roller arranged opposing to the reversing roller; taking the sheets in a second direction differing from the first direction after reversing by the reversing portion and conveying on the second conveying path; and controlling a conveyance of the sheets so that the conveying gap of the sheets conveyed on the second conveying path becomes equal to the specified gap when conveyed on the first conveying path regardless of the lengths of the plural sheets.

DETAILED DESCRIPTION OF A PREFERRED EMBODIMENT OF THE INVENTION

A preferred embodiment of this invention will be described below referring to the attached drawings.

Figure 1A:
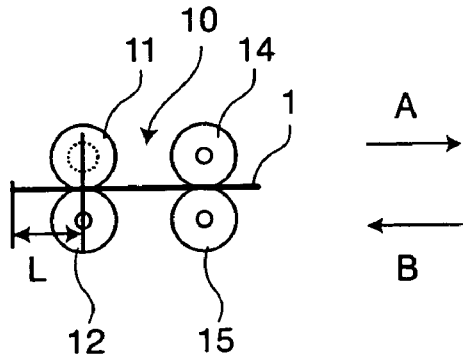
FIG. 1A (PRIOR ART)
FIG. 1A to FIG. 1D are schematic diagram showing a length of a sheet protruding from the reversing roller and a pinch roller by an existing conveying control, respectively.
Figure 1B:
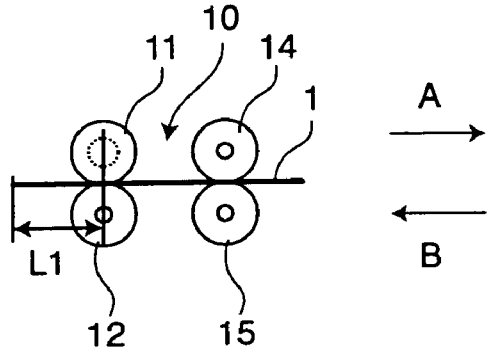
FIG. 1B (PRIOR ART)
Figure 1C:
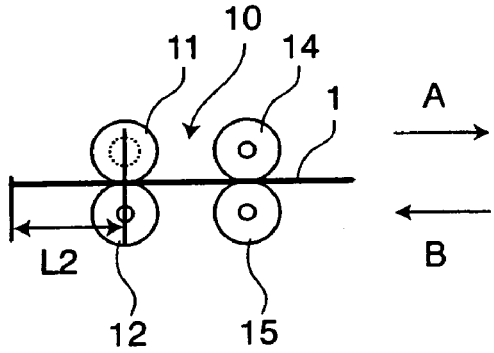
FIG. 1C (PRIOR ART)
Figure 1D:
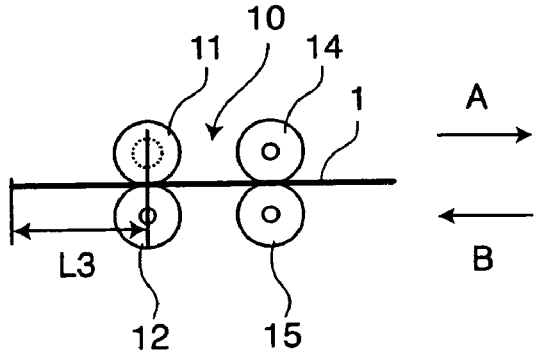
FIG. 1D (PRIOR ART)
Figure 2:
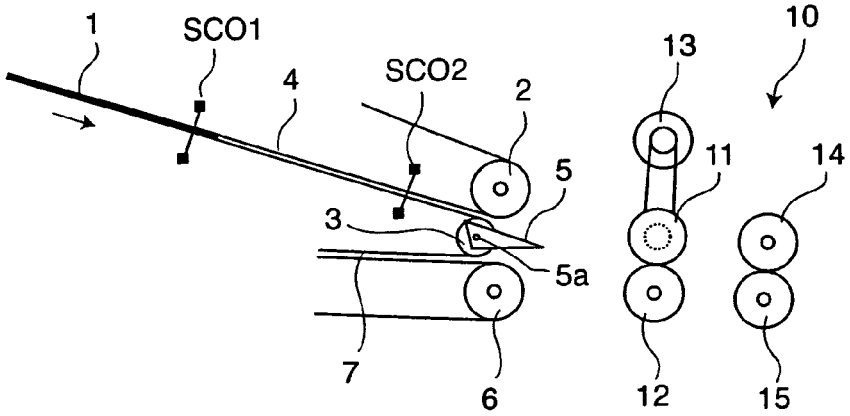
FIG. 2 is a sectional side view of a sheet reversing gear showing an embodiment of this invention.

FIG. 2 is a schematic sectional side view of a reversing controller of sheets showing an embodiment of this invention. A sheet 1 is a medium being conveyed such as a postal matter.

The reversing controller is composed of a first conveying path 4, a length sensor SCO1, a timing sensor SCO2, a switching gate 5, a reversing portion 10, a conveying roller 6, and a second conveying path 7. The switching gate 5 has a flap shape to oscillate centering around a pivot 5*a* provided coaxially on the rotary shaft of the pinch roller 3 that will be described later.

The first conveying path 4 conveys the sheet 1 in the first direction that is the arrow direction A.

The length sensor SCO1 is arranged in the first conveying path 4 and detects a length of the sheet 1 arranged at the upper stream of the conveying path 4.

The timing sensor SCO2 is used to set up a conveying control timing of the sheet 1 arranged at the downstream of the conveying path.

The sensors SCO1 and SCO2 are composed of a light emitting element and a photo accepting element to receive a light from the light emitting element, respectively.

The length sensor SCO1 detects the length of the sheet 1 being conveyed by measuring a time of light shielded by the sheet 1.

The timing sensor SCO2 detects the front end of the sheet 1 at the moment when the light is shielded.

The switching gate 5 sorts the conveyed sheets 1.

The conveying roller 2 and the pinch roller 3 are provided in front of the switching gate 5.

The reversing portion 10 takes in and reverses the sheets 1 sorted by the switching gate 5.

The conveying roller 6 and the second conveying path 7 take in the sheets 1 sent from the reversing portion 10 and convey them in the second direction that is the reverse direction to the conveying direction of the first conveying path 4.

The reversing portion 10 comprises a reversing roller 11 capable of rotating in the normal and reverse directions for taking and reversing the sheets 1 conveyed on the first conveying path 4, the pinch roller 12 arranged opposite to the reversing roller 11, conveying rollers 14 and 15 that are capable of rotating in the normal and reverse directions, and a reversing roller drive motor 13.

The reversing roller 11 is connected to the reversing roller drive motor 13 and is driven normal or reverse directions by this reversing roller drive motor 13. The reversing roller drive motor 13 is connected to a controller 9 (see FIG. 3).

Figure 3:
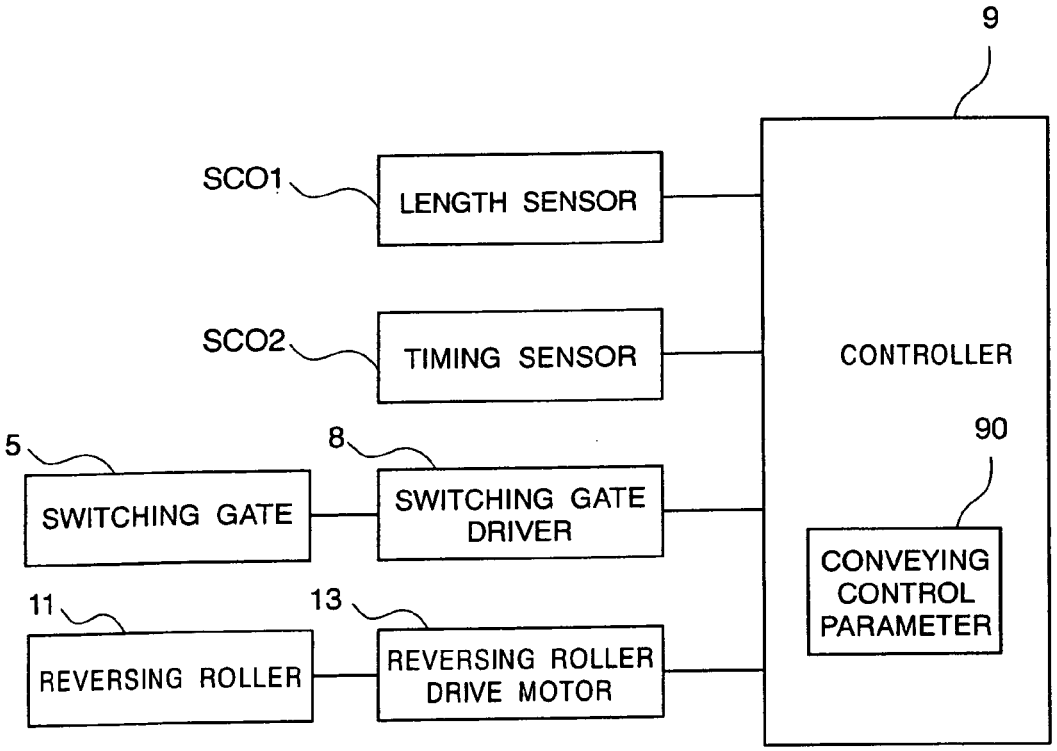
FIG. 3 is a block diagram showing the construction of a control circuit of a reverse controller.

FIG. 3 is a block diagram showing the construction of the control circuit of the reversing controller.

The output signals from the length sensor SCO1 and the timing sensor SCO2 are input to the controller 9.

The switching gate 5 is connected to a switching gate driver 8 and driven by this switching gate driver 8. The switching gate driver 8 is connected to the controller 9.

The switching gate driver 8 rotates the switching gate 5 clockwise when the sheets 1 are conveyed to the reversing portion 10 through the first conveying path 4. Further, the switching gate driver 8 rotates the switching gate 5 counterclockwise when the sheets 1 are conveyed to the second conveying path 7 from the reversing portion 10.

The controller 9 detects the lengths of the sheets 1 in the conveying direction from the output signal of the length sensor SCO1 and detects the front ends of the sheets 1 from the output signal of the timing sensor SCO2. Further, the controller 9 controls the switching gate driver 8 and rotates the switching gate 5 clockwise or counterclockwise to set the conveying direction of the sheet 1.

Further, the controller 9 sets up a conveying control parameter 90 in order for setting the rotating velocity in the normal/reverse direction and the rotating velocity in the reverse direction of the reversing roller 11 and the pinch roller 12 of the reversing portion 10.

Next, using FIG. 4 to FIG. 10, the operation of conveying the sheets 1 through the reverse control will be explained.

Figure 4:
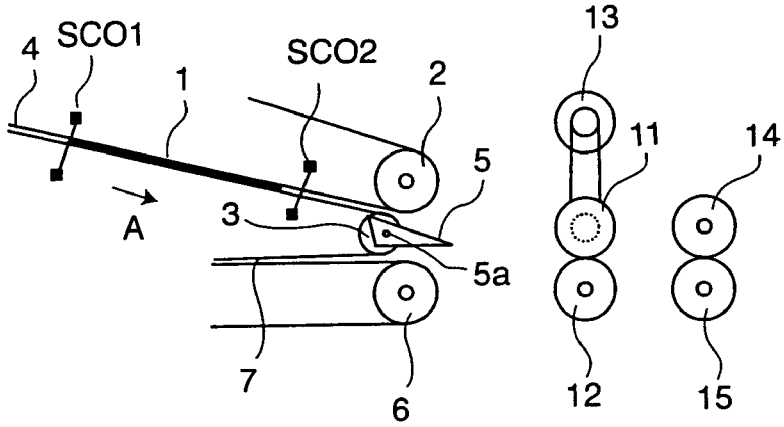
FIG. 4 is a schematic sectional side view showing the moment when the rear end of a sheet changed from the dark state of a length sensor to the light state.

FIG. 4 shows the state of the sheet 1 at the moment when the sheet 1 was conveyed on the first conveying path in the arrow direction A, its rear end passed the length sensor SCO1 and the light from the light emitting element was changed from the shaded state to the acceptable state by the light receiving element. At this time, the controller 9 discriminates whether the sheet 1 has a length suited to the detecting medium and measures the length of the sheet 1 by counting a time of the light shaded in the length sensor SCO1 by the time unit clock.

Then, when the sheet 1 is suited to a detecting medium, the controller 9 rotates the switching gate 5 clockwise and conveys the sheet 1.

Figure 5:
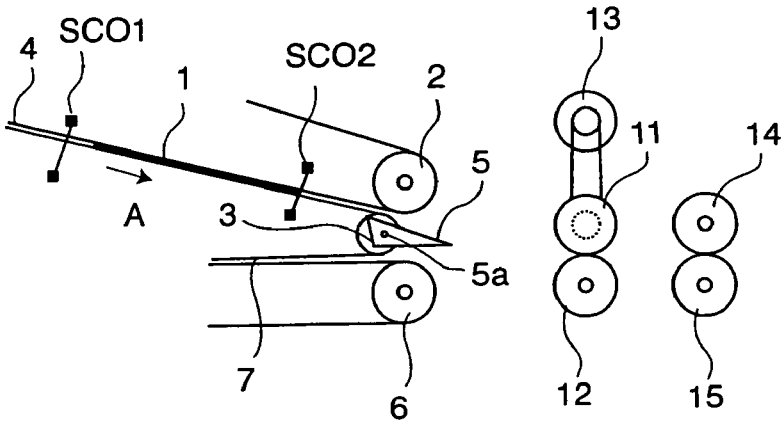
FIG. 5 is a schematic sectional side view showing the moment when the front end of a sheet reaches a timing sensor.
Figure 10A:
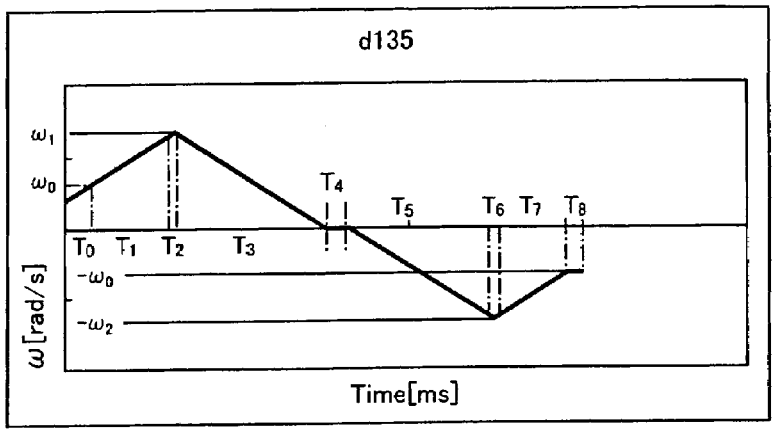
FIG. 10A to FIG. 10C are diagrams showing velocity patterns relative to a reversing roller drive control.
Figure 10B:
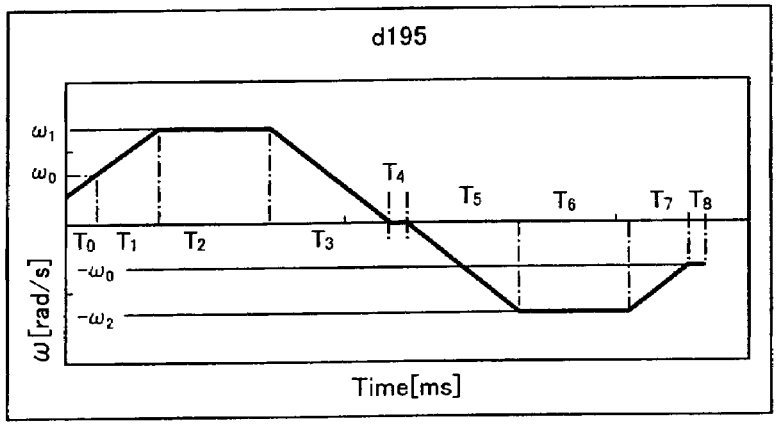
Figure 10C:
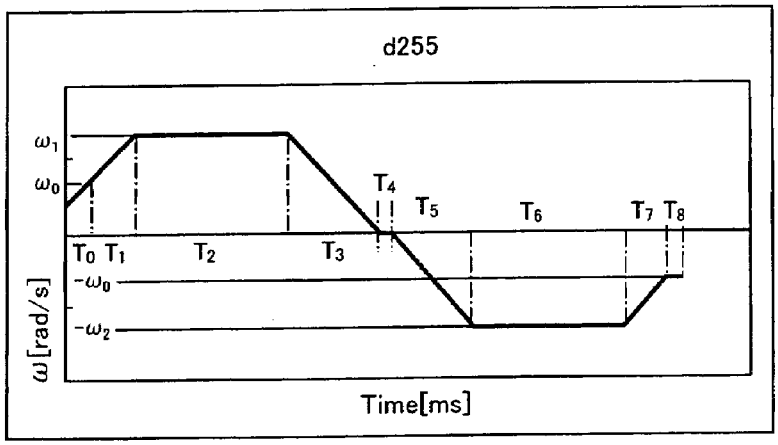

FIG. 5 is a diagram showing the moment when the front end of the sheet 1 reaches the timing sensor SCO2. Further, timing diagrams showing the relation of subsequent conveying time and velocity are shown in FIG. 10A to FIG. 10C. Here, the controller 9 sets the conveying control parameter 90 that is set according to the above-mentioned length of the sheet 1 in the reversing roller drive motor 13 and as a result, the reversing roller 11 is rotated in the normal direction. In this case, the rotating velocity $\omega_o$ of the reversing roller 11 is set for the conveying control parameter 90 so that the conveying velocity of the first conveying path 4 agrees with the tangential velocity that is a velocity in the tangential direction of the outer surface of the reversing roller 11 within a time $T_O$ until the front end of the sheet 1 reaches the nip between the reversing roller 11 and the pinch roller 12.

Figure 6:
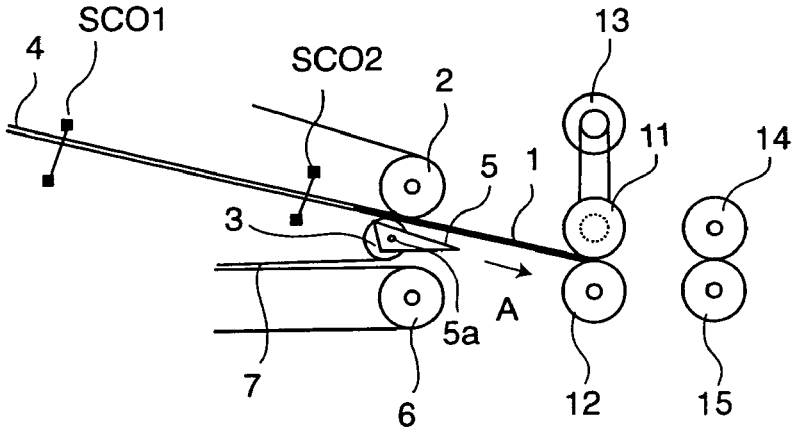
FIG. 6 is a schematic sectional side view showing the moment when the front end of a sheet reaches a nip between the reversing roller and the pinch roller.

FIG. 6 is a diagram showing the moment when the front end of the sheet 1 reaches the nip between the reversing roller 11 and the pinch roller 12. Here, because the front end of the sheet 1 reached the nip between the reversing roller 11 and the pinch roller 12, the rotating velocity is so set that the tangential velocity that is a velocity in the tangential direction of the outer surface of the reversing roller 11 reaches the conveying velocity of the first conveying path 4. The rotating velocity of the reversing roller 11 reached the velocity $\omega_o$ and therefore, the sheet 1 is smoothly taken in the reversing portion 10.

However, when the tangential velocities of the reversing roller 11 and the pinch roller 12 are not equal to the conveying velocity of the first conveying path 4, a force caused by a difference in conveying velocities is applied to the sheet 1 and the sheet 1 may be damaged.

Therefore, a one-way roller is used for the conveying roller 2 and when, for example, the tangential velocity at the side of the reversing roller 11 and the pinch roller 12 is fast, the conveying roller 2 is able to run idle. Thus, it becomes possible to prevent the sheet 1 from being damaged.

In succession, the controller 9 accelerates the rotating velocity of the reversing roller 11 by a specified time $T_1$ by controlling the reversing roller drive motor 13 based on the conveying control parameter 90 and then, rotates the reversing roller 11 at a rotating velocity $\omega_1$ that is faster than a rotating velocity $\omega_O$ for a specified time $T_2$, then decelerates the velocity for a specified time $T_3$ and stops the reversing roller 11.

Figure 7:
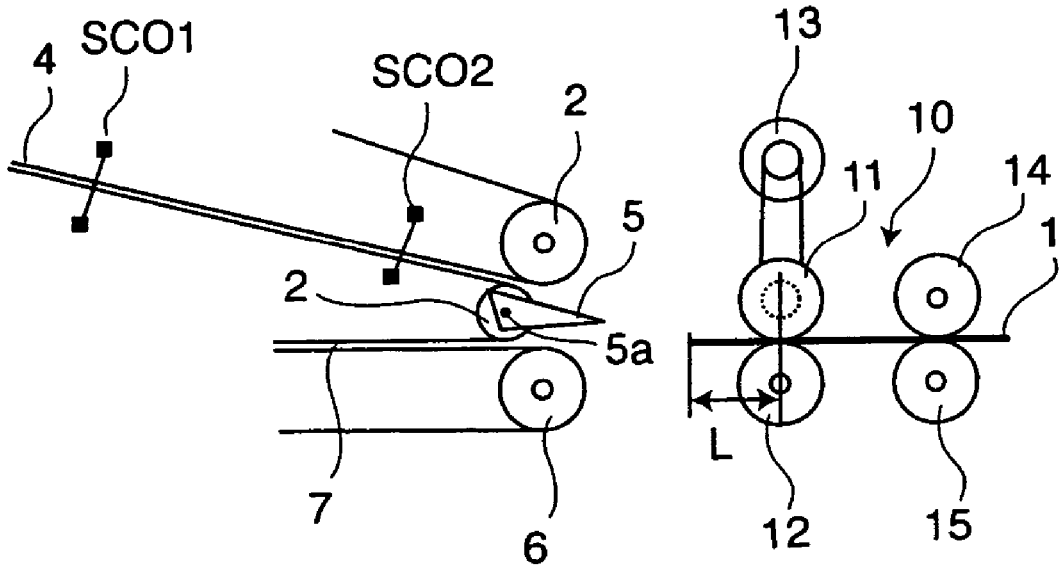
FIG. 7 is a schematic sectional side view showing the moment when a sheet is stopped in the state protruding in a length L from the reversing roller and the pinch roller.

FIG. 7 is a diagram showing the sheet 1 stopped in the state protruded from the reversing roller 11 and the pinch roller 12 by a length L. Here, the sheet 1 is stopped for a certain fixed time $T_4$.

FIG. 8A to FIG. 8D are diagrams showing the length L of the sheet 1 protruding from the reversing roller 11 and the pinch roller 12 by the conveying control in the embodiment of this invention, respectively. Here, the length L of the sheet 1 protruding from the reversing roller 11 and the pinch roller 12 as a result of the conveying control for changing the conveying control parameter 90 for every sheet 1 of optional length is shown.

Figure 8A:
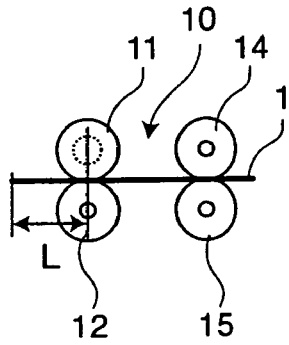
FIG. 8A to FIG. 8D are schematic diagrams showing a protruding length L of a sheet from the reversing roller and the pinch roller by the conveying control in the embodiment of this invention, respectively.
Figure 8B:
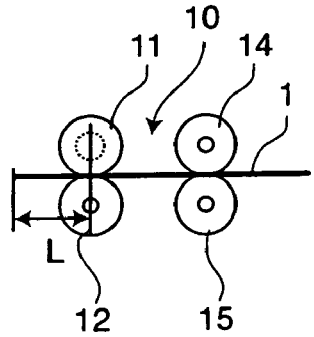
Figure 8C:
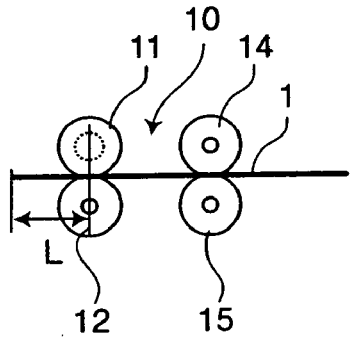
Figure 8D:
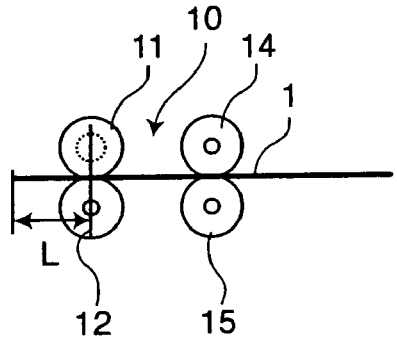

When the length of the sheet 1 shown in FIG. 8A is used as a standard, the length of the sheet shown in FIG. 8B is longer than the length of the sheet 1 shown in FIG. 8B. The length of the sheet 1 shown in FIG. 8D is longer than the length of the sheet 1 shown in FIG. 8C.

However, in all cases shown in FIG. 8A to FIG. 8D, the conveyance of the sheet 1 is controlled based on the conveying control parameter 90 so that the length L protruding from the reversing roller 11 and the pinch roller 12 becomes constant.

Figure 9:
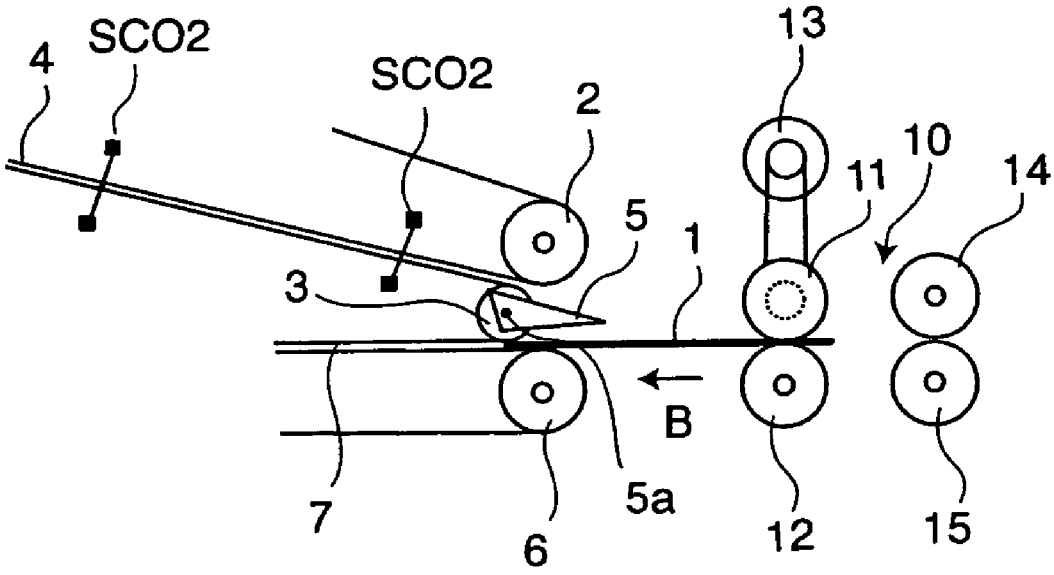
FIG. 9 is a schematic sectional side view showing the state of a sheet sent out in a second conveying path.

FIG. 9 shows the state of the sheet 1 that was driven in the reverse direction by the reversing roller 11 and the pinch roller 12 and sent to the second conveying path 7. Here, the reversing roller 11 and the pinch roller 12 are accelerated in the reverse direction for a specified time $T_5$ so that the tangential velocity of the reversing roller 11 and the pinch roller 12 becomes the rotational velocity $-\omega_2$ faster than the conveying velocity from the stopped state of the sheet. Then, the reversing roller 11 and the pinch roller 12 are rotated at the rotational velocity $-\omega_2$ for a specified time $T_6$ and decelerated for a specified time $T_7$, and after reaching the rotational velocity $-\omega_O$ where the tangential velocity of the reversing roller 11 is turned to the reverse direction at the same size of the conveying velocity of the second conveying path, and this rotational velocity $-\omega_O$ is maintained for a time $T_8$ until the sheet 1 is completely separated from the reversing roller 11 and the pinch roller 12.

Also in this case, as explained in FIG. 6, when the tangential velocity of the reversing roller 11 and the pinch roller 12 is not equal to the conveying velocity of the second conveying path 7, a force caused from the difference in the velocities is applied to the sheet 1 and the sheet 1 may be damaged in some cases.

Therefore, a one-way roller is used for the conveying roller 6 and when the rotational velocity is fast at the reversing roller 11 and the pinch roller 12 side and the sheet 1 is fed at a high velocity, the conveying roller 6 is able to run idle.

Thus, the sheet 1 is taken into the second conveying path 7.

FIG. 10A to FIG. 10D are diagrams showing the velocity patterns relative to the control of the reversing roller drive motor 13 when the conveying control parameter 90 is set according to a size of the sheet 1. In FIG. 10A to FIG. 10D, $\omega_O$ (rad/S) is a standard rotational velocity of the reversing roller 11.

$T_O$ is a time of the rotational velocity of the reversing roller 11 to reach $\omega_O$.

$T_1$ is a time of the rotational velocity of the reversing roller 11 is being accelerated to $\omega_1$ from $\omega_O$.

$T_2$ is a time of the reversing roller 11 rotating at a constant velocity of $\omega_1$.

$T_3$ is a time of the reversing roller 11 being decelerated from the rotational velocity $\omega_1$ to 0.

$T_4$ is a time of the reversing roller 11 kept stopped.

$T_5$ is a time of the rotational velocity of the reversing roller 11 being accelerated in the reverse direction from the rotational velocity 0 to $-\omega_2$.

$T_6$ is a time of the reversing roller 11 being rotated at a constant velocity of $-\omega_2$.

$T_7$ is a time of the rotational velocity of the reversing roller 11 being decelerated from $-\omega_2$ to $\omega_O$.

$T_8$ is a time of the reversing roller 11 rotating at a constant velocity $-\omega_O$.

At this time, the sheet 1 is sent to the second conveying path 7 at the rotational velocity $-\omega_O$ from the reversing roller 11 and the pinch roller 12.

FIG. 10A is a velocity pattern diagram relative to the reversing roller drive control of the sheet d 135 that is a 135 mm long sheet 1.

FIG. 10B is a velocity pattern diagram relative to the reversing roller drive control of the d195 sheet that is a 195 mm long sheet 1.

FIG. 10C is a velocity pattern diagram relative to the reversing roller drive control of the d255 sheet that is a 255 mm long sheet 1.

The d195 sheet is longer than the d135 sheet and therefore, the time $T_2$ rotating at the rotational velocity $\omega_1$ and the time $T_6$ rotating at the rotational velocity $-\omega_2$ become long. The d255 sheet is longer than the d195 sheet and the time $T_2$ rotating at the rotational velocity $\omega_1$ and the time $T_6$ rotating at the rotational velocity $-\omega_2$ become further long.

Thus, the sheet 1 having a long length is conveyed at a high velocity while the reversing roller 11 is rotated at a higher rotational velocity ($\omega_1$ at the normal rotation, $-\omega_2$ at the reversing) than the standard rotational velocity ($\omega_O$ at the normal rotation, $-\omega_O$ at the reversing) for a longer time. As a result, the conveying gap between the sheets 1 becomes uniform and the high density conveyance becomes possible.

Figure 11:
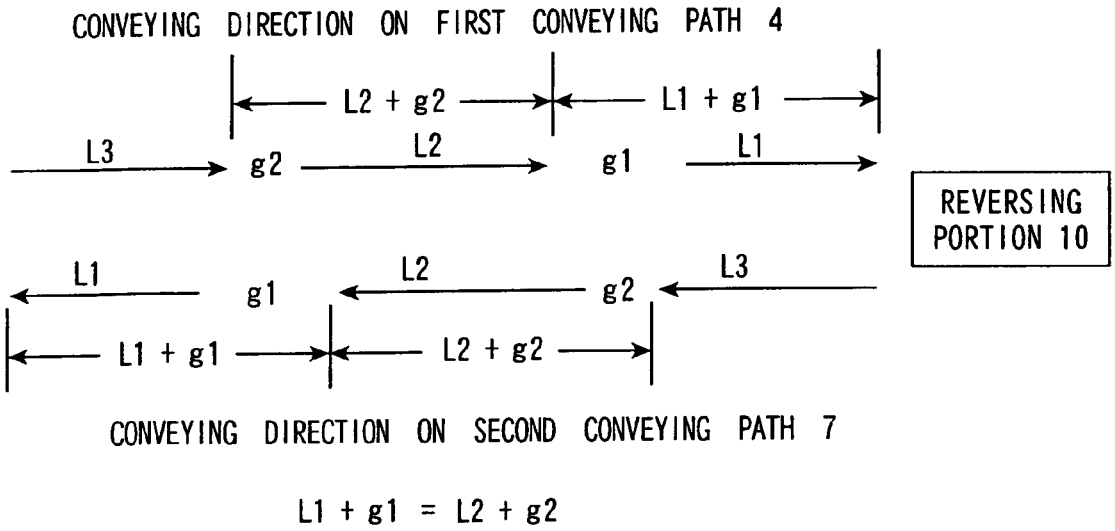
FIG. 11 is a schematic diagram for explaining the sheet conveying state before and after the reversing.

FIG. 11 shows the state of plural sheets 1 being conveyed after the reversing while keeping the gap between the sheets before the reversing without changing the conveying pitch. That is, the sheets $\mathbf{1}_1$, $\mathbf{1}_2$ and $\mathbf{1}_3$ having lengths L1, L2 and L3, respectively are conveyed on the first conveying path 4 with the conveying gaps g1 and g2. Accordingly, the conveying pitch between the first conveyed sheet $\mathbf{1}_1$ and the next conveyed sheet $\mathbf{1}_2$ is L1+g1 and the conveying pitch between the sheet $\mathbf{1}_2$ second conveyed second and the sheet $\mathbf{1}_3$ third conveyed is L2+g2. These conveying pitches are equally set. That is, L1+g1=L2+g2. The sheets $\mathbf{1}_1$, $\mathbf{1}_2$ and $\mathbf{1}_3$ conveyed on the second conveying path 7 after reversed by the reversing portion 10 are conveyed without changing this conveying pitch.

As explained above, according to the above embodiment, the longer sheets 1 can be taken into the reversing portion 10 from the first conveying path and fed out into the second conveying path 7 from the reversing portion 10 faster than the shorter sheets 1 and therefore, it becomes possible to convey plural sheets conveyed on the first conveying path 4 so that the conveying gap between plural sheets becomes equal to the conveying gap between plural sheets conveyed on the second conveying path after the reversing. That is, plural sheets 1 are conveyed without changing the conveying gap between plural sheets conveyed on the first conveying path 4 before reversing against the conveying gap between plural sheets conveyed on the second conveying path 7 after the reversing.

Further, the protruding amount of sheets can be set optionally by the arrangement of the switching gate 5 and the reversing portion 10 and therefore, it is possible to provide a sheet reversing controller capable of high density conveying.

As explained above, according to this invention, the protruding length of sheets when the sheets are stopped at the reversing portion can be controlled to a fixed length regardless sheet lengths and therefore, the conveying gaps between sheets become constant before and after the reversing and the high density conveying can be realized.

Further, as the switchback reversing in the high density conveying is enabled, a compact and economical sheet reversing controller can be provided.

What is claimed is:

1. A sheet reversing controller comprising:

a first conveying path to convey a plurality of sheets in a first direction with a specified gap;

a reversing portion arranged at the downstream in the first direction of the first conveying path, the reversing portion comprising a reversing roller capable of normal and reverse rotations to take and reverse the sheets from the first conveying path and a pinch roller arranged opposing to the reversing roller;

a second conveying path to take and convey the sheets fed in a second direction differing from the first direction of the first conveying path by the reversing portion; and a controller to control a tangential velocity of an outer surface of the reversing roller so that the reversing roller takes the sheets from the first conveying path at a tangential velocity that is the same as a conveying velocity of the first conveying path and supplies the sheets taken therein to the second conveying path at another tangential velocity, in the reverse rotation, that is higher than the conveying velocity of the first conveying path, such that a conveying gap between a first sheet and a second adjacent succeeding sheet that are conveyed on the second conveying path becomes equal to the specified gap when conveyed on the first conveying path regardless of lengths of the sheets, wherein the controller sets a protruding amount of the sheets protruding between the reversing portion and the second conveying path when the sheets are stopped for reversing the conveying direction of the sheets to a fixed length regardless of the lengths of the sheets.

2. The sheet reversing controller according to claim 1, wherein the controller controls a tangential velocity of the reversing roller when rotating in the normal rotation so as to agree with a conveying velocity of the sheets before the sheets fed from the first conveying path reach the reversing roller in the reversing portion.

3. The sheet reversing controller according to claim 1, wherein the controller controls a tangential velocity of the reversing roller when rotating in a reverse rotation to feed the sheets in the second direction differing from the first direction of the first conveying path so as to agree with a conveying velocity of the second conveying path to take and convey the sheets.

4. A sheet reversing control method comprising:

conveying plural sheets on the first conveying path in a first direction with a specified gap;

taking and reversing the sheets fed from the first conveying path in a reversing portion arranged at the downstream in the first direction of the first conveying path comprising a reversing roller that is capable of normal and reverse rotations and a pinch roller arranged opposing to the reversing roller;

taking the sheets in a second direction differing from the first direction after reversing by the reversing portion and conveying on a second conveying path; and controlling a tangential velocity of an outer surface of the reversing roller so that the reversing roller takes the sheets from the first conveying path at a tangential velocity that is the same as a conveying velocity of the first conveying path and supplies the sheets taken therein to the second conveying path at another tangential velocity, in the reverse rotation, higher than the conveying velocity of the first conveying path, such that a conveying gap of the sheets conveyed on the second conveying path becomes equal to the specified gap when conveyed on the first conveying path regardless of lengths of the plural sheets, wherein the controlling includes controlling a protruding amount of the sheets between the reversing portion and the second conveying path when stopping the sheets for reversing the conveying direction of the sheets to a fixed length.

5. The sheet reversing control method according to claim 4, wherein the controlling includes controlling a tangential velocity of the reversing roller in the normal rotation to agree with a conveying velocity of the sheets before the sheets from the first conveying path reach the reversing roller of the reversing portion.

6. The sheet reversing control method according to claim 4, wherein the control step controls a tangential velocity of the reversing roller when rotating in the reverse rotation to feed the sheets in the second direction differing from the first direction of the first conveying path so as to agree with a conveying velocity of the second conveying path to take and convey the sheets.

7. The sheet reversing controller according to claim 1, wherein control of the conveyance of the sheets so that the conveying gap between the sheets conveyed on the second conveying path becomes equal to the specified gap when conveyed on the first conveying path regardless of lengths of the sheets is done with a single inverter.

8. The sheet reversing control method according to claim 4, wherein said controlling includes controlling a conveyance of the sheets so that a conveying gap of the sheets conveyed on the second conveying path becomes equal to the specified gap when conveyed on the first conveying path regardless of the lengths of the sheets with a single inverter.

9. The sheet reversing controller according to claim 1, wherein said controller is configured to control the reversing roller to (a) convey the sheets at a velocity higher than a conveying velocity of the second conveying path when rotating the reversing roller in the reverse rotation and (b) feed the sheets to the second conveying path at a velocity that is substantially the same as the conveying velocity of the second conveying path.

10. The sheet reversing control method according to claim 4, wherein said controlling includes controlling the reversing roller to (a) convey the sheets at a velocity higher than a conveying velocity of the second conveying path when rotating the reversing roller in the reverse rotation and (b) feed the sheets to the second conveying path at a velocity that is substantially the same as the conveying velocity of the second conveying path.

* * * * *